US010219659B1

(12) United States Patent
Armstrong

(10) Patent No.: US 10,219,659 B1
(45) Date of Patent: Mar. 5, 2019

(54) INCLINING TOILET-SEAT LIFT

(71) Applicant: Joe Armstrong, Remlap, AL (US)

(72) Inventor: Joe Armstrong, Remlap, AL (US)

( * ) Notice: Subject to any disclaimer, the term of this patent is extended or adjusted under 35 U.S.C. 154(b) by 0 days.

(21) Appl. No.: 15/816,817

(22) Filed: Nov. 17, 2017

(51) Int. Cl.
*A47K 13/10* (2006.01)
*A47K 11/06* (2006.01)
*A61G 7/10* (2006.01)

(52) U.S. Cl.
CPC ..... *A47K 13/10* (2013.01); *A47K 11/06* (2013.01); *A61G 7/1007* (2013.01)

(58) Field of Classification Search
CPC ..... A47K 13/10; A47K 13/105; A47K 11/06; A61G 7/107; A61G 7/1001; A61G 7/10
USPC ..... 4/667
See application file for complete search history.

(56) References Cited

U.S. PATENT DOCUMENTS 4,587,678 A * 5/1986 Love ..... A47K 17/026 297/330
5,189,739 A * 3/1993 Thierry ..... A47K 13/28 4/237
6,189,164 B1 * 2/2001 Krapu ..... A61G 5/14 297/313
2005/0235414 A1 * 10/2005 Cavanagh ..... A61G 7/1007 4/667
2009/0313753 A1 * 12/2009 Campbell ..... A61G 5/14 4/667
2014/0338119 A1 * 11/2014 Henshaw ..... A61G 7/1007 4/667
2014/0346745 A1 * 11/2014 Ganel ..... A61G 5/1002 280/47.4
2017/0143174 A1 * 5/2017 Rife ..... A47K 13/10

* cited by examiner

*Primary Examiner* — Huyen Le

(57) ABSTRACT

An inclining toilet-seat lift is an apparatus that aids and supports a user while transitioning from a standing position to a sitting position, and vice versa, in order to relieve himself or herself. The apparatus includes a U-shaped base, a plurality of supporting legs, a platform, a posterior-bracing plate, an excrement-receiving hole, and a lifting mechanism. The U-shaped base upholds the plurality of supporting legs and the lifting mechanism. The plurality of supporting legs upholds the platform and the posterior-bracing plate. The platform supports and mounts the posterior-bracing plate, which rotates about a first edge of the platform and supports a user as the user sits down and stands up. The excrement-receiving hole allows a toilet or a bucket to collect excrement without the excrement coming into contact with the platform and the posterior-bracing plate. The lifting mechanism lowers and raises the posterior-bracing plate onto and from the platform.

18 Claims, 11 Drawing Sheets

INCLINING TOILET-SEAT LIFT

FIELD OF THE INVENTION

The present invention relates generally to seat lifts. More specifically, the present invention is an inclining toilet-seat lift.

BACKGROUND OF THE INVENTION

Everyday tasks can be extremely challenging and sometimes fatal as a person ages. Such tasks included walking, taking the stairs, getting into and out of cars, and so on. One everyday task that can be extremely dangerous due to the number of surfaces of which an elderly person may hit his or her head on is using the restroom. More specifically, using a toilet can be extremely difficult and dangerous as an elderly person has to switch from a standing position to a sitting position, and vice versa. This transition affects the balance of the elderly person and strains the legs and knees of the elderly person. If an elderly person falls while attempting to sit on or get up from a toilet, the elderly person may easily hit his or her head against the toilet, a nearby sink, and so on.

The present invention supports and guides a user as the user attempts to relieve himself or herself. The present invention is compatible with existing toilets and is able to effectively collect the excrement of the user. The user is preferably an elderly person who may need aid while attempting to use a toilet. However, the present invention may assist anyone who is having difficulty switching from a standing position to a sitting position, and vice versa. The present invention provides a reliable stable surface that supports the user while transitioning between positions. The present invention may be used with a toilet or standalone with a bucket.

DETAILED DESCRIPTION OF THE INVENTION

All illustrations of the drawings are for the purpose of describing selected versions of the present invention and are not intended to limit the scope of the present invention.

Figure 1:
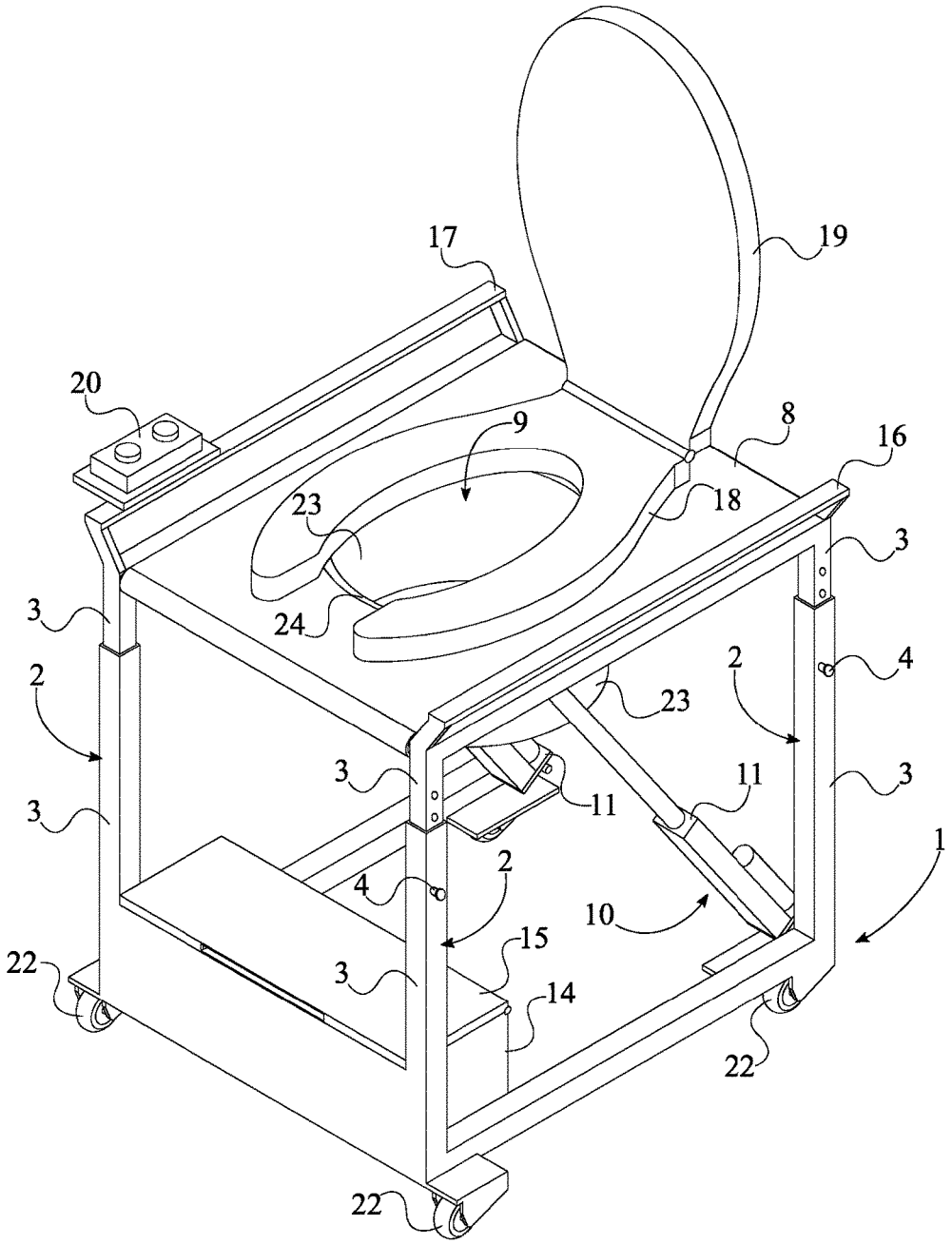
FIG. 1 is a front perspective view of the present invention with the plurality of legs retracted.
Figure 2:
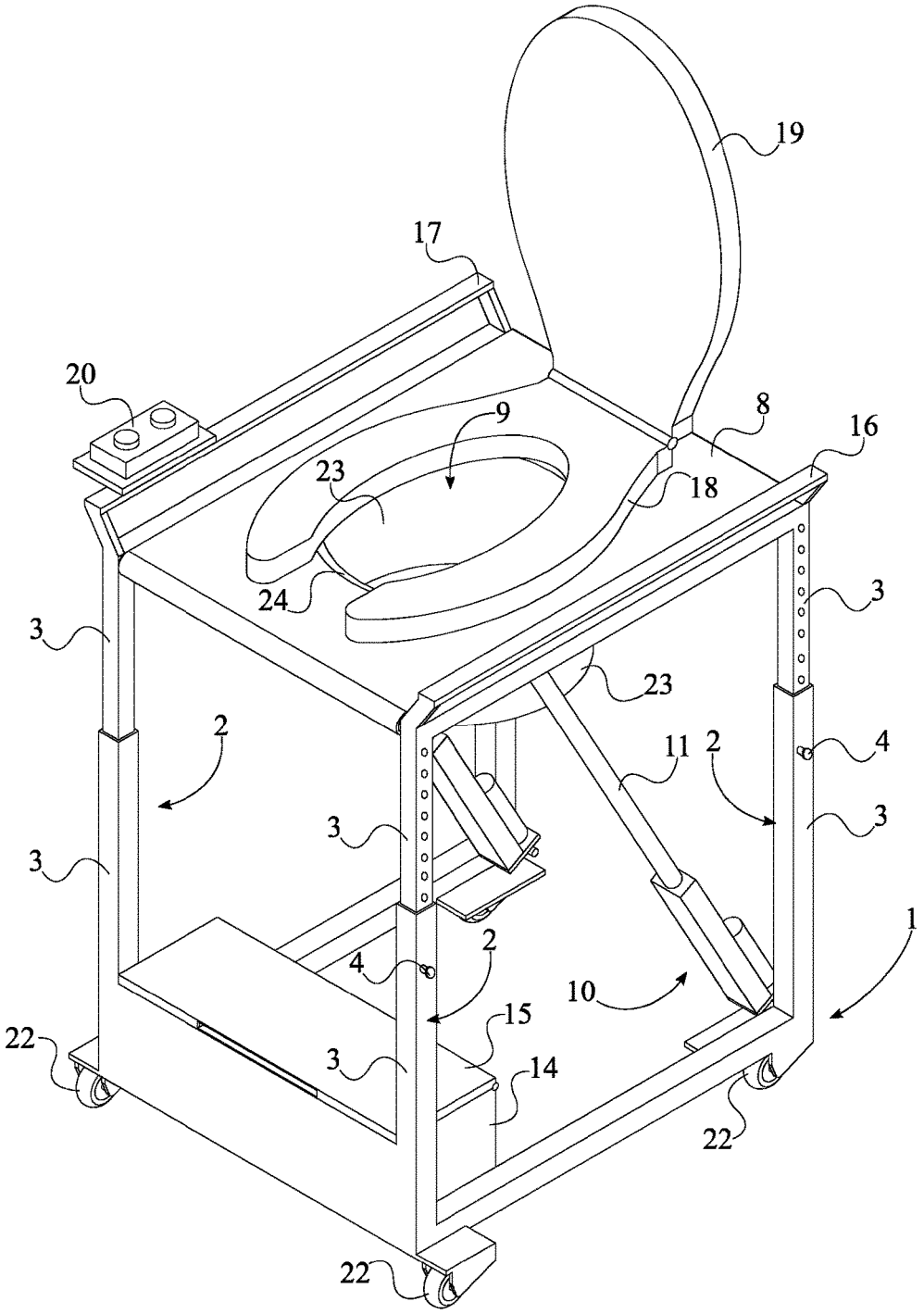
FIG. 2 is a front perspective view of the present invention with the plurality of legs extended.
Figure 9:
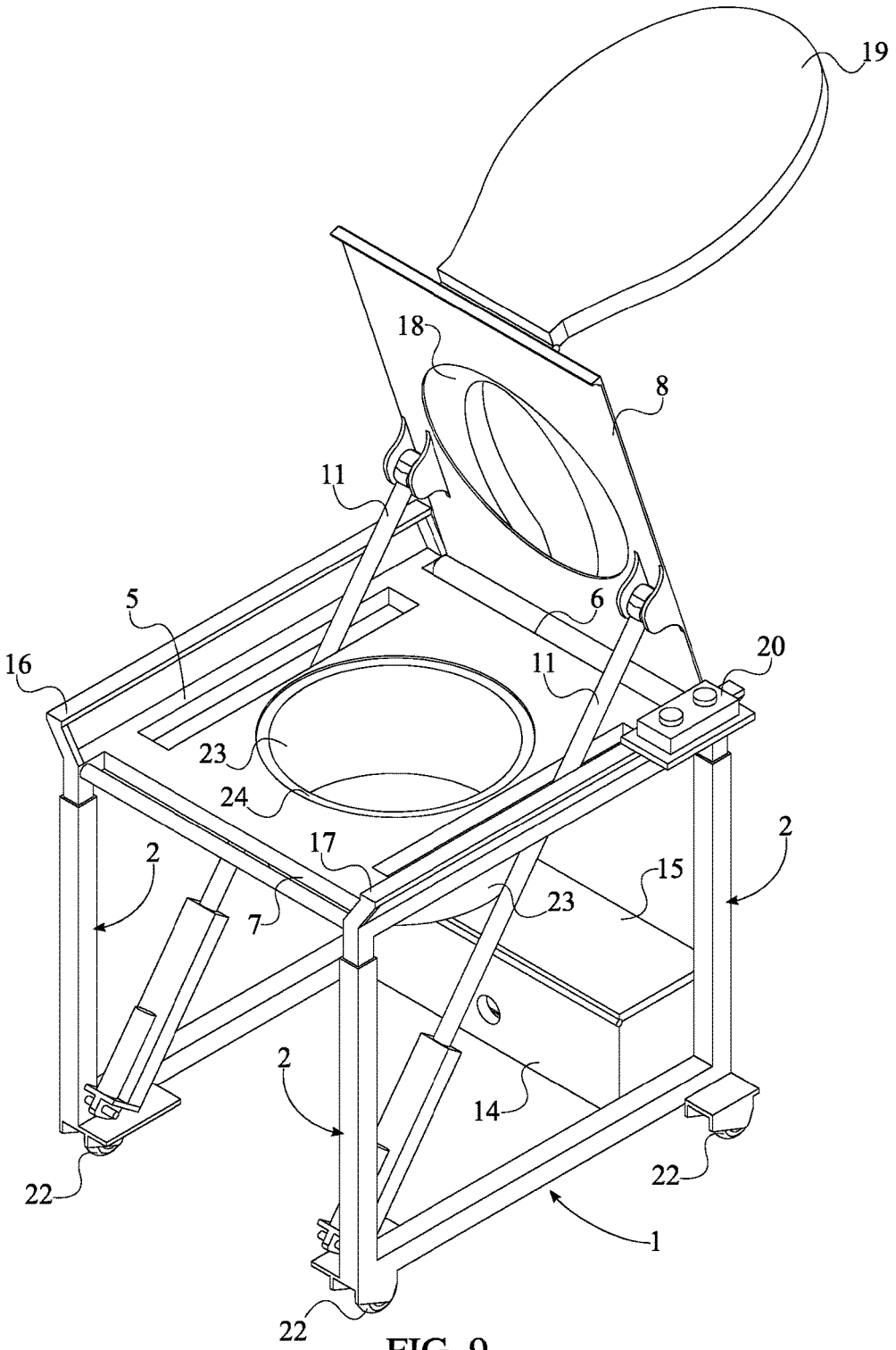
FIG. 9 is a rear perspective view of the present invention with the plurality of legs retracted and the posterior-bracing plate in an extended configuration.

The present invention is an inclining toilet-seat lift that supports and aids a user while transitioning from a standing position to a sitting position, and vice versa. More specifically, the present invention supports and aids the user while using a toilet. The present invention is both compatible with an existing toilet and able to contain the urine and excrement of the user without an existing toilet. In order for the present invention to support and aid the user, as the user sits on the apparatus to urinate and defecate, the present invention comprises a U-shaped base 1, a plurality of supporting legs 2, a platform 5, a posterior-bracing plate 8, an excrement-receiving hole 9, and a lifting mechanism 10, as illustrated in FIG. 1 and FIG. 9. The U-shaped base 1 upholds both the plurality of supporting legs 2 and the lifting mechanism 10, and consequently, upholds the platform 5 and the posterior-bracing plate 8. The U-shaped base 1 receives an existing toilet such that the existing toilet is aligned with and positioned beneath the excrement-receiving hole 9. The plurality of supporting legs 2 upholds the platform 5 and the posterior-bracing plate 8 above the ground. The plurality of supporting legs 2 preferably comprise a height that exceeds past the height of an existing toilet. The platform 5 supports and mounts the posterior-bracing plate 8. The posterior-bracing plate 8 supports the user backside of the user. More specifically, the posterior-bracing plate 8 raises and lowers the user from and onto the platform 5, respectively. The excrement-receiving hole 9 allows any excrement from the user to fall through the platform 5 and the posterior-bracing plate 8 without coming into contact with the present invention. The lifting mechanism 10 raises and lowers the posterior-bracing plate 8 from the platform 5 so that the user is supported as the user transitions from a standing position to a sitting position while on the posterior-bracing plate 8, and vice versa. The platform 5 comprises a first edge 6 and a second edge 7 such that the first edge 6 mounts the posterior-bracing plate 8 and allows the posterior-bracing plate 8 to rotate, and the second edge 7 supports the posterior-bracing plate 8 in a fully retracted configuration. In the fully retracted configuration, the posterior-bracing plate 8 is pressed against the platform 5.

Figure 10:
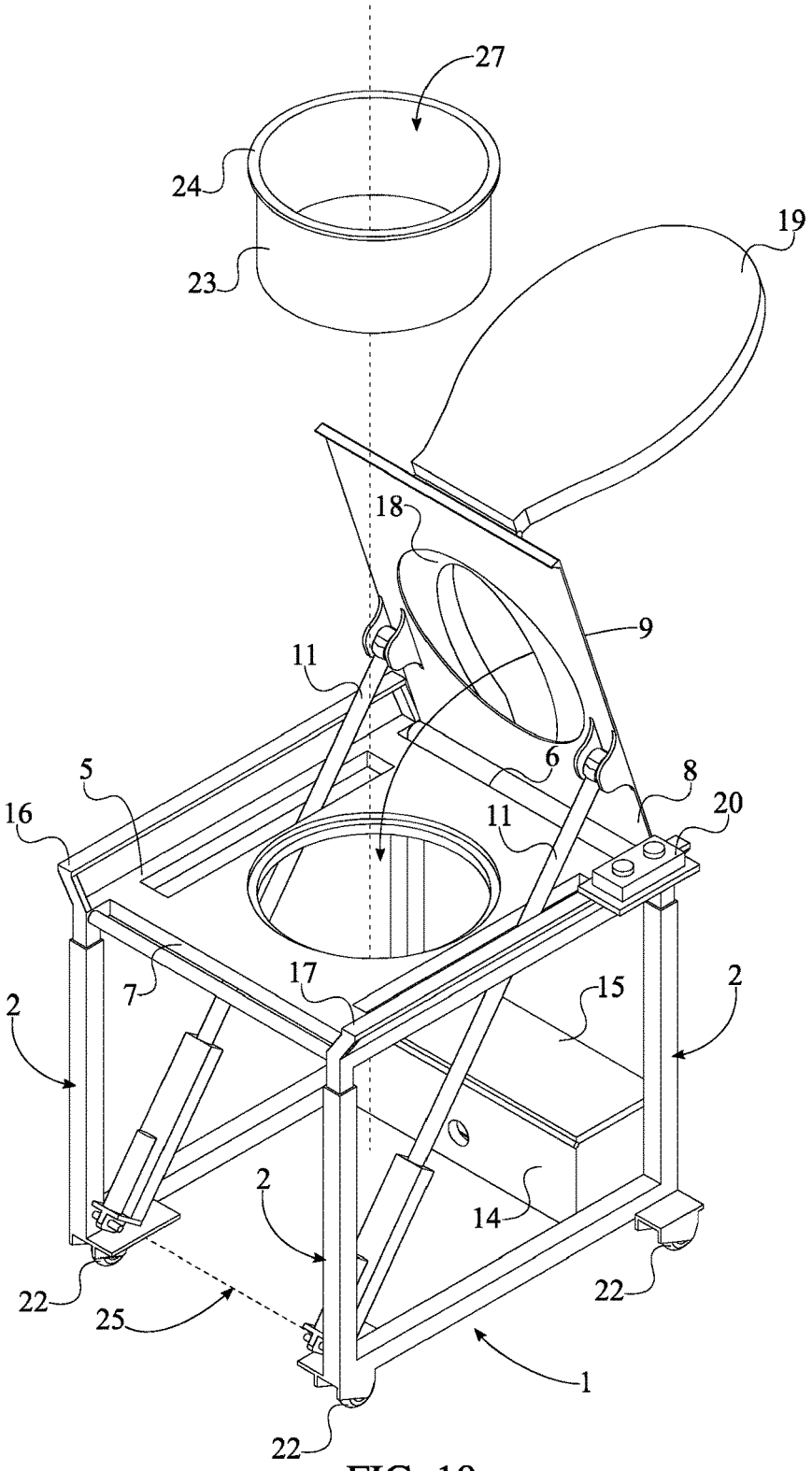
FIG. 10 is an exploded view of the present invention with the plurality of legs retracted and the posterior-bracing plate in an extended configuration.

The overall configuration of the aforementioned components aids a user before and after relieving himself or herself. As seen in FIG. 9 and FIG. 10, the first edge 6 and the second edge 7 are positioned opposite to each other across the platform 5 in order for the posterior-bracing plate 8 to be structurally supported while in the fully retracted configuration. The present invention is compatible with an existing toilet as the second edge 7 is positioned adjacent to an opening 25 of the U-shaped base 1, seen in FIG. 10. Moreover, as the second edge 7 is positioned adjacent to the opening 25, the user may press against the posterior-bracing plate 8 and sit on the posterior-bracing plate 8. This arrangement aligns the user with the existing toilet as if the user was sitting directly on the existing toilet.

Figure 7:
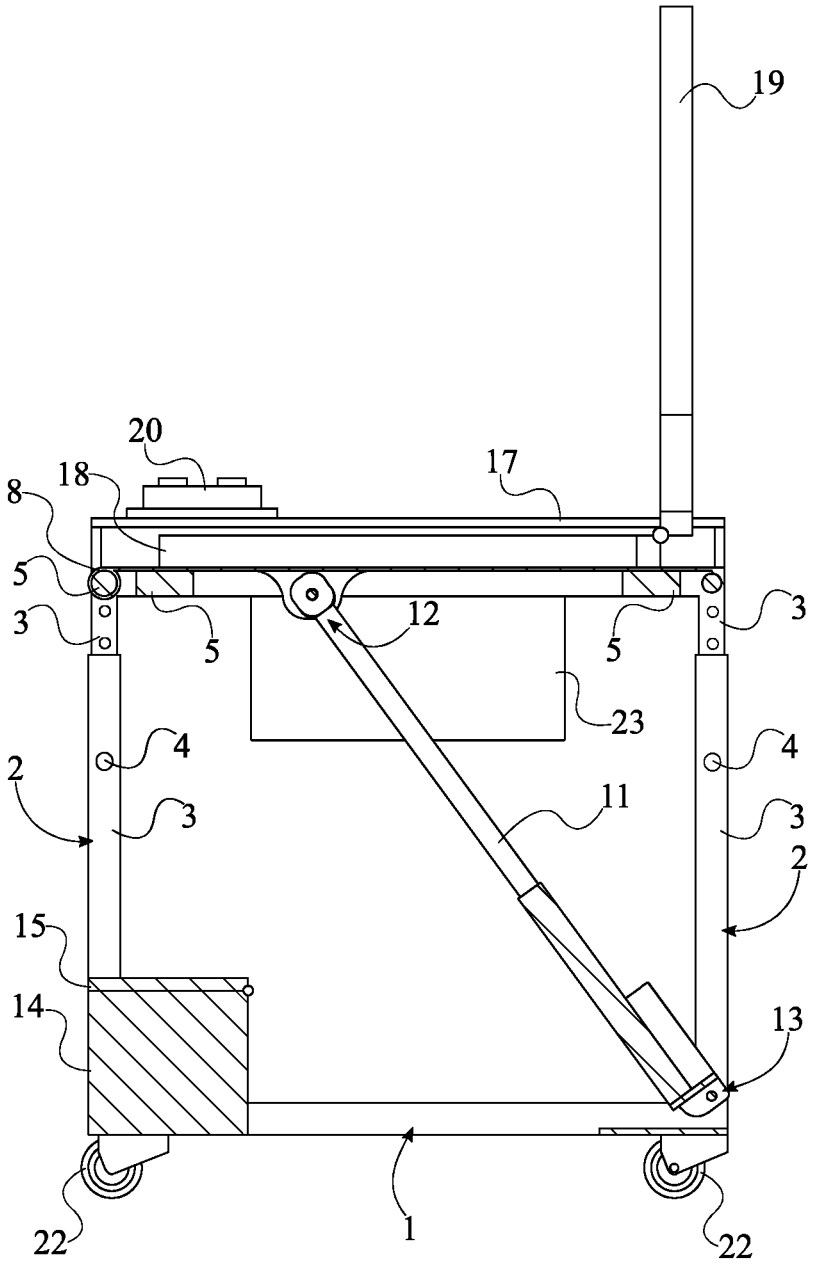
FIG. 7 is a cross-section view of the FIG. 6 along line 7-7.

In order to effectively support the platform 5, and consequently the posterior-bracing plate 8, the platform 5 is terminally connected to the plurality of supporting legs 2, seen in FIG. 7, FIG. 9, and FIG. 10, and the plurality of supporting legs 2 is peripherally positioned around the platform 5. The U-shaped base 1 is terminally connected to the plurality of supporting legs 2, opposite the platform 5, thereby distancing the platform 5 from the U-shaped base 1. This arrangement positions the platform 5, and consequently the posterior-bracing plate 8, above the existing toilet, allowing the toilet to collect the excrement that falls through the excrement-receiving hole 9.

As seen in FIG. 9 and FIG. 10, the posterior-bracing plate 8 is positioned adjacent to the platform 5, opposite the plurality of supporting legs 2 and is hingedly connected along the first edge 6. This arrangement allows the transition of the user from a standing position to a sitting position, and vice versa, while pressed against the posterior-bracing plate 8 to be continuous and correctly aligns the user with the existing toilet. More specifically, the excrement-receiving hole 9 traverses through the posterior-bracing plate 8 and the platform 5 such that the excrement from the user falls directly into the existing toilet. The posterior-bracing plate 8 is able to rotate and support the user while transitioning from a standing position to a sitting position, and vice versa, as the lifting mechanism 10 is operatively coupled between the posterior-bracing plate 8 and the U-shaped base 1, wherein the lifting mechanism 10 is used to raise and lower the posterior-bracing plate 8.

Figure 3:
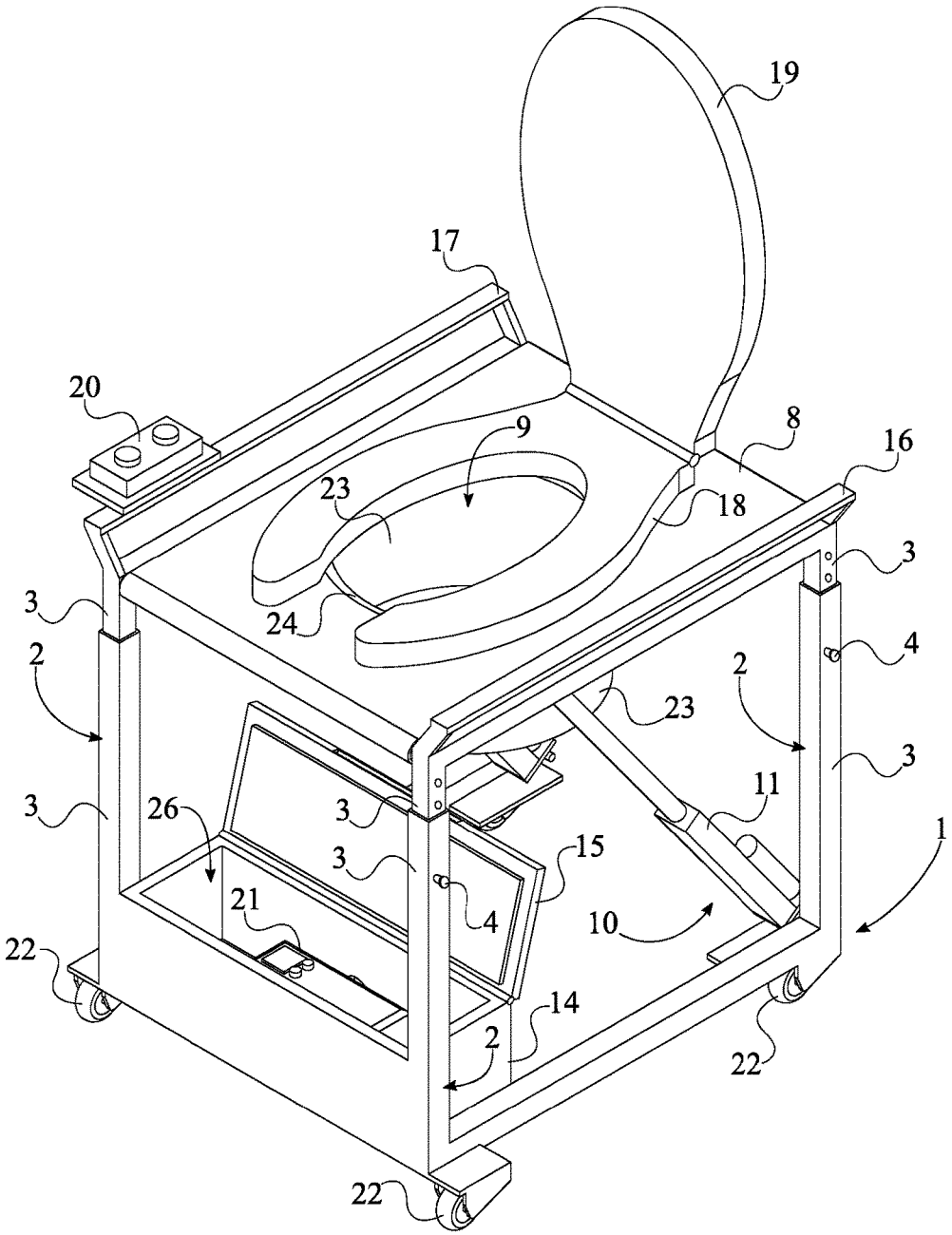
FIG. 3 is a front perspective view of the present invention with the cover disengaged from the bin and the plurality of legs retracted.

In order to contain any toiletries, the present invention further comprises a bin 14 and a cover 15, clearly seen in FIG. 1, FIG. 2, FIG. 3, FIG. 9, and FIG. 10. The bin 14 houses any toiletries and the cover 15 conceals the toiletries. The bin 14 is mounted onto the U-shaped base 1, and the cover 15 is detachably attached across an opening 26 of the bin 14, as shown in FIG. 3. The allows the bin 14 to remain accessible while the user is sitting on the present invention and the present invention is positioned around an existing toilet.

The present invention accommodates users and existing toilets of varying heights as each of the plurality of supporting legs 2 comprises a series of telescopic rods 3 and a locking mechanism 4, seen in FIG. 1, FIG. 2, FIG. 3, and FIG. 7. The series of telescopic rods 3 allows the height of each of the plurality of supporting legs 2 to adjust accordingly. The locking mechanism 4 fixes the position the series of telescopic rods 3 with respect to each other, thereby securing the desired height of each of the plurality of supporting legs 2. In order for the position of the series of telescopic rods 3 to be adjustable with respect to each other, the series of telescopic rods 3 is slidably engaged amongst each other. The locking mechanism 4 is operatively integrated into the series of telescopic rods 3, wherein the locking mechanism 4 is used to adjust and fix a total length for the series of telescopic rods 3. The locking mechanism 4 preferably comprises a plurality of holes and a bolt. The plurality of holes laterally traverses into each of the series of telescopic rods 3 and is distributed across each of the series of telescopic rods 3. The bolt traverses into an arbitrary hole of an arbitrary telescopic rod that is aligned with a corresponding hole of an adjacent telescopic rod. The arbitrary telescopic rod is preferably, the outermost telescopic rod of the series of telescopic rods 3.

The user may further stabilize himself or herself onto the present invention as the present invention comprises a first handlebar 16 and a second handlebar 17. The first handlebar 16 and the second handlebar 17 both allow a user to effectively grasp onto the present invention. As seen in FIG. 1, FIG. 9, and FIG. 10, the first handlebar 16 is mounted adjacent to the platform 5, and the second handlebar 17 is mounted adjacent to the platform 5, opposite the first handlebar 16. This arrangement allows the first handlebar 16 and the second handlebar 17 to be accessible to the user, regardless of the position of the user. More specifically, the first handlebar 16 and the second handlebar 17 are positioned in between the first edge 6 and the second edge 7 such that the path of the posterior-bracing plate 8 about the first edge 6 is uninhibited.

The preferred embodiment of the present invention comprises a toilet seat 18, shown in FIG. 1, FIG. 2, FIG. 3, and FIG. 6. The toilet seat 18 positions the user onto the posterior-bracing plate 8 and provides comfort to the user as the user presses against the posterior-bracing plate 8. The toilet seat 18 is mounted onto the posterior-bracing plate 8, opposite the platform 5 in order for the user to be able to come into contact with the toilet seat 18 as the posterior-bracing plate 8 rotates about the first edge 6. The toilet seat 18 effectively positions the user onto the present invention as the toilet seat 18 is perimetrically positioned around the excrement-receiving hole 9. An alternate embodiment of the present invention further comprises a seat cover 19. The seat cover 19 prevents the user or any object from accidentally falling through the excrement-receiving hole 9 and conceals the exposure of both the excrement-receiving hole 9 and excrement beneath the platform 5. In order to cover the excrement-receiving hole 9, the seat cover 19 is coextensive with the toilet seat 18. The seat cover 19 is hingedly connected to the posterior-bracing plate 8, allowing the user to access and cover 15 the excrement-receiving hole 9. More specifically, the hinged connection between the seat cover 19 and the posterior-bracing plate 8 is positioned adjacent to the toilet seat 18.

Figure 4:
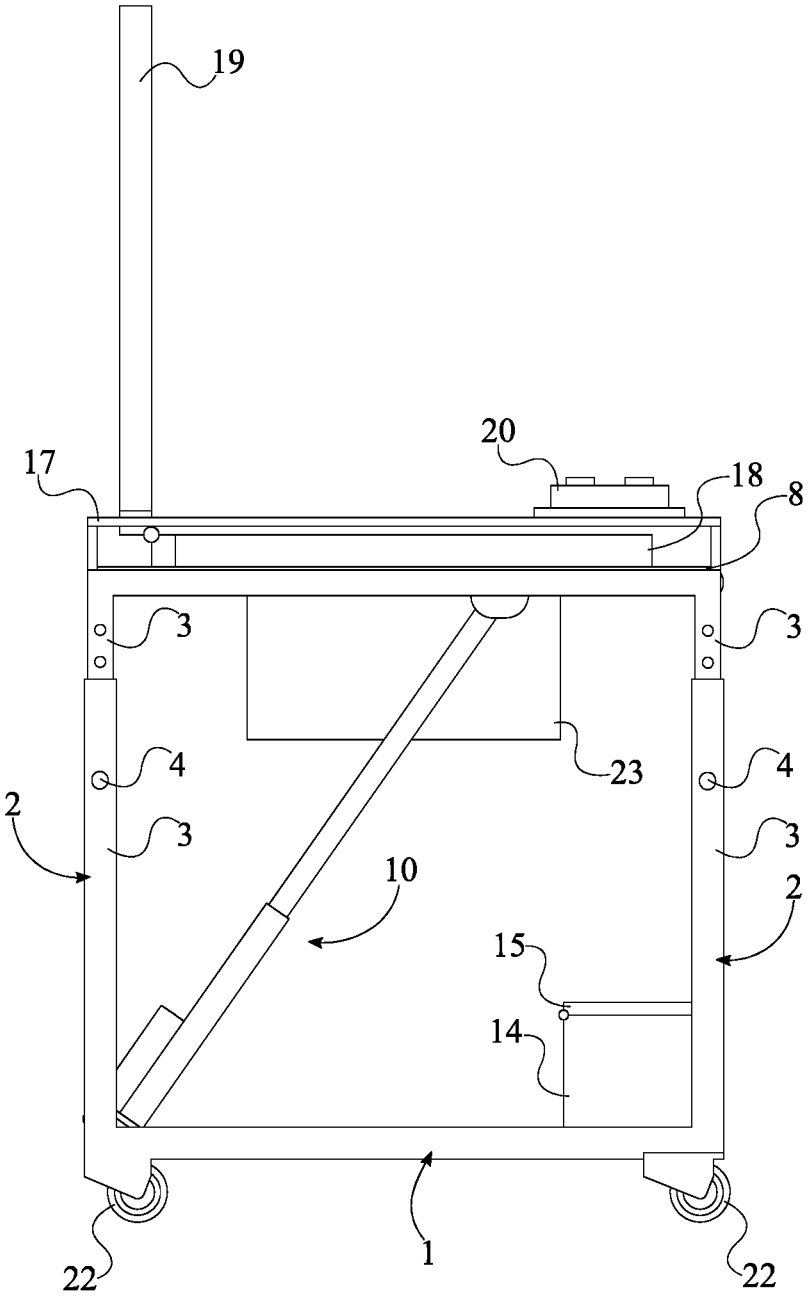
FIG. 4 is a left side view of the present invention with the plurality of legs retracted and the posterior-bracing plate in a retracted configuration.
Figure 5:
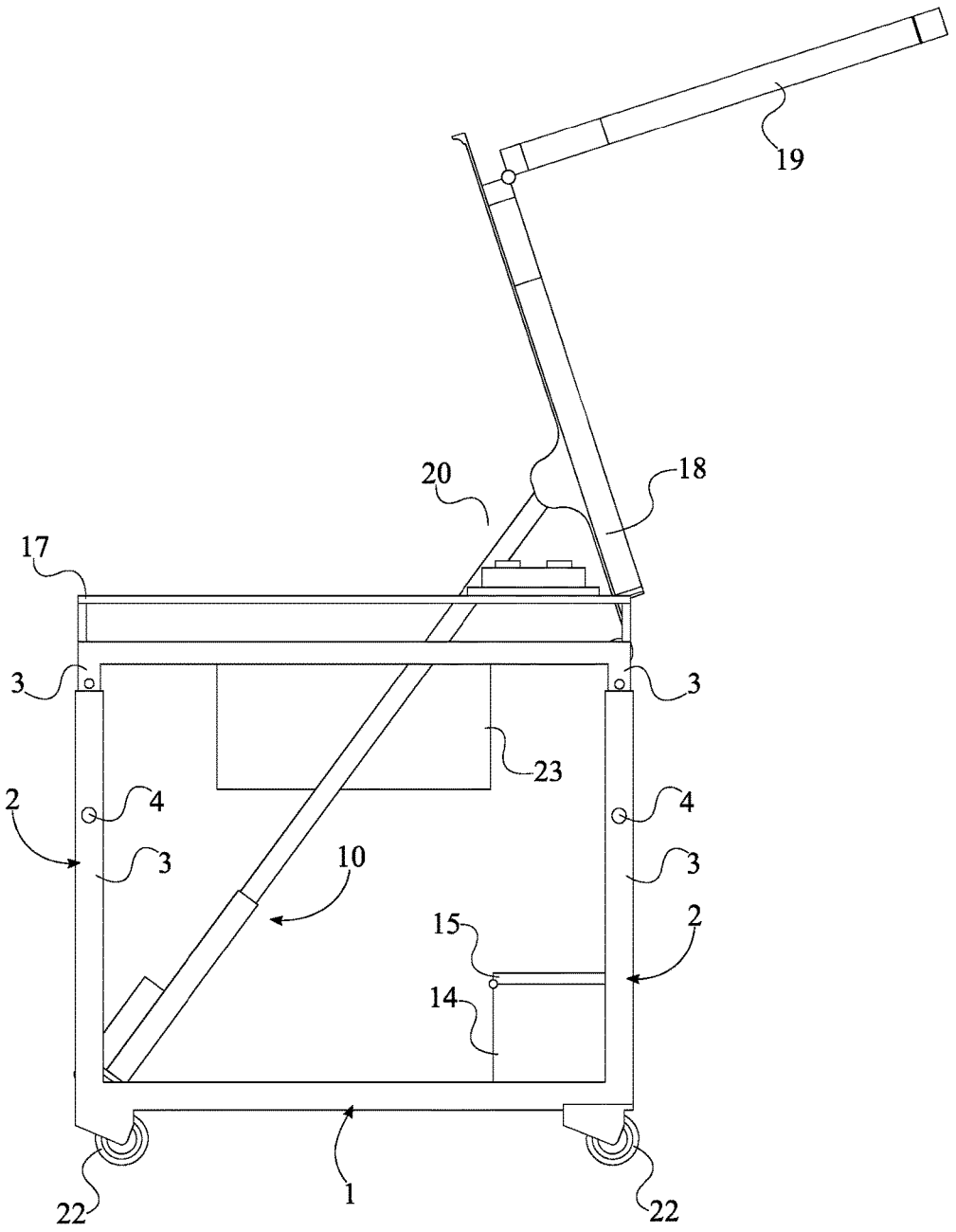
FIG. 5 is a left side view of the present invention with the plurality of legs retracted and the posterior-bracing plate in an extended configuration.
Figure 6:
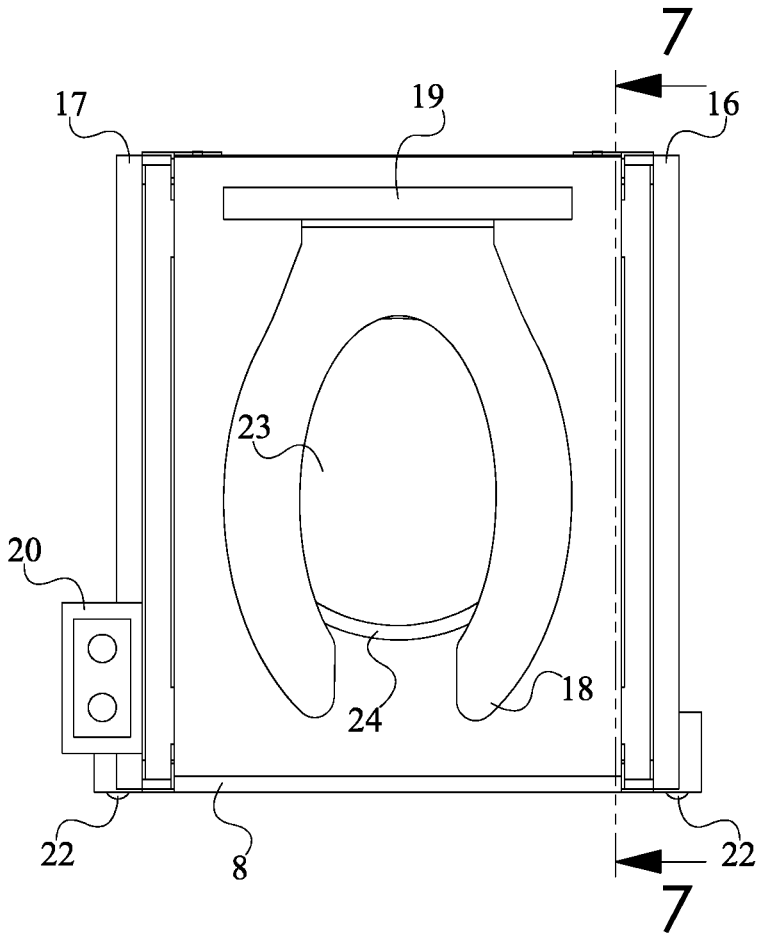
FIG. 6 is a top side view of the present invention with the posterior-bracing plate in a retracted configuration.

In order for the posterior-bracing plate 8 to rotate about the first edge 6, the lifting mechanism 10 comprises at least one linear actuator 11, as seen in FIG. 1, FIG. 9, and FIG. 10. The at least one linear actuator 11 automatically lifts and lowers posterior-bracing plate 8, as well as supports the weight of the user while pressing against the posterior-bracing plate 8. The at least one linear actuator 11 comprises a pushing end 12 and a fixed end 13, as seen in FIG. 7. The pushing end 12 applies force against the posterior bracing plate, and the fixed end 13 connects the lifting mechanism 10 to the U-shaped base 1. More specifically, the fixed end 13 is pivotably connected to the U-shaped base 1, and the pushing end 12 is pivotably connected to the posterior-bracing plate 8. This pivotal connection accommodates the rotary motion of the posterior-bracing plate 8, seen in FIG. 4 and FIG. 5. The pushing end 12 is positioned offset from the hinged connection between the posterior-bracing plate 8 and the platform 5 so that the at least one linear actuator 11 is able to rotate the posterior-bracing plate 8 about the first edge 6.

Figure 11:
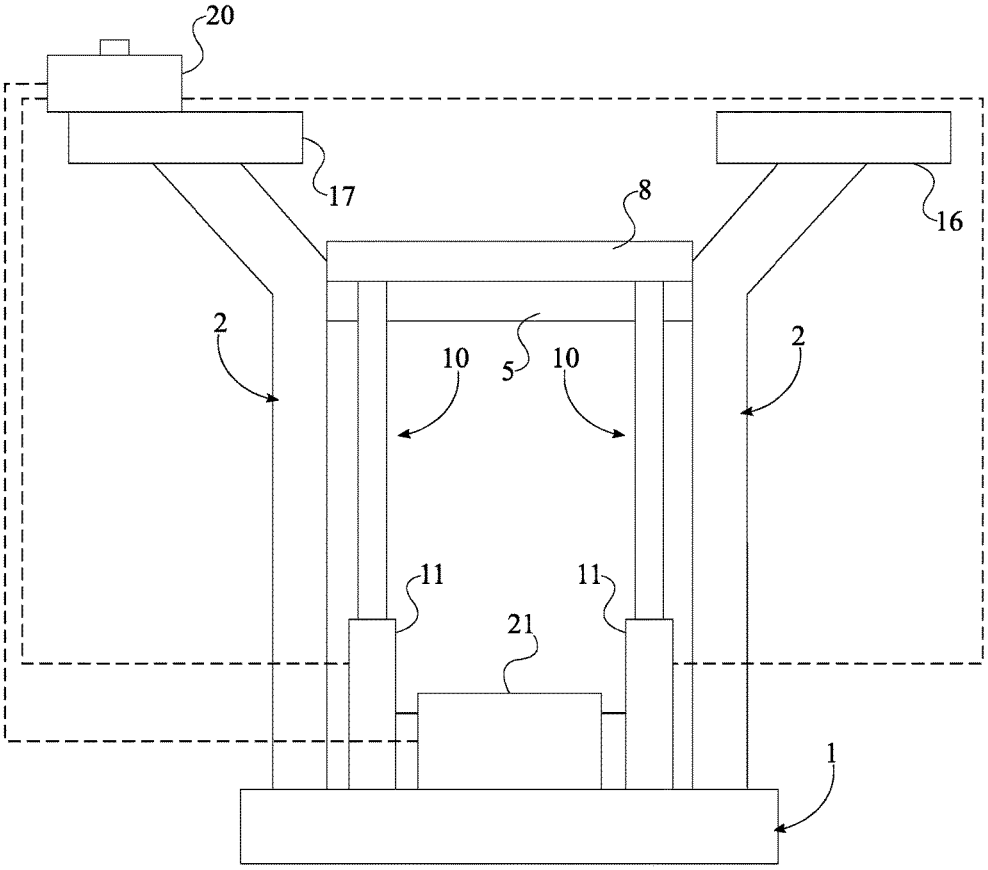
FIG. 11 is a schematic view of the electrical connections of the electronic components of the present invention.

In order to activate and deactivate the lifting mechanism 10, the present invention further comprises a control unit 20 and a power source 21, as illustrated in FIG. 3. The control unit 20 allows a user to engage the lifting mechanism 10 without having to manually lift and lower the posterior-bracing plate 8. The power source 21 provides the necessary power to the lifting mechanism 10. The control unit 20 is connected adjacent to the platform 5. In the preferred embodiment of the present invention, the control unit is mounted on either the first handlebar 16 or the second handlebar 17. More specifically, the control unit 20 is positioned in between the plurality of supporting legs 2 and the posterior-bracing plate 8 so that the user may easily access the control unit 20. The control unit 20 is electronically connected to the lifting mechanism 10 so that the lifting mechanism automatically raises and lowers upon input from the user with the control unit 20. In order for the power source 21 to remain connected to the electronic components of the present invention while the present invention is moved, the power source 21 is mounted onto the U-shaped base 1. In the preferred embodiment of the present invention, the power source 21 is contained within the bin 14 and concealed by the cover 15. As illustrated in FIG. 11, the power source 21 is electrically connected to the control unit 20 and the lifting mechanism 10 in order for the control unit 20 and the lifting mechanism 10 to receive power from the power source 21. The power source 21 is preferably a replaceable battery. In alternate embodiments of the present invention, the power source 21 may be positioned external to the U-shaped base 1 and be electrically connected to the control unit 20 and the lifting mechanism 10 via a cable.

Figure 8:
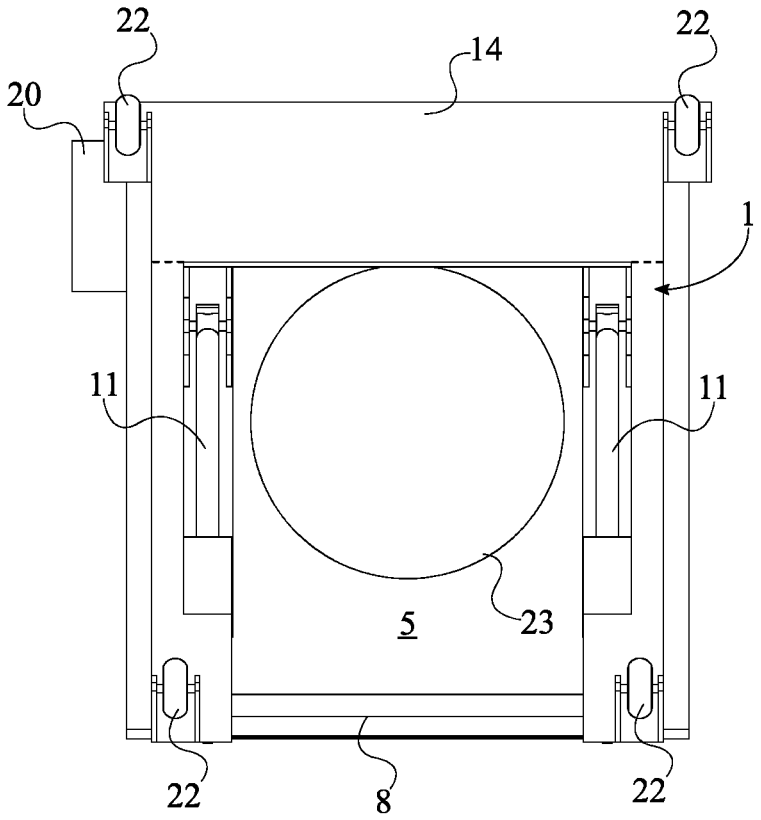
FIG. 8 is a bottom side view of the present invention with the posterior-bracing plate in a retracted configuration.

The preferred embodiment of the present invention comprises a plurality of wheel assemblies 22, seen in FIG. 1 and FIG. 9, so that the present invention is easily transported and maneuverable. The plurality of wheel assemblies 22 is mounted adjacent to the U-shaped base 1, opposite to the plurality of supporting legs 2 in order for the plurality of wheel assemblies 22 to come into contact with the ground and reduce the friction between the present invention and the ground. Furthermore, the plurality of wheel assemblies 22 is distributed around the U-shaped base 1, as illustrated in FIG. 8, thereby structurally supporting and balancing the U-shaped base 1 above the ground.

The preferred embodiment of the present invention further comprises a bucket 23 and a rim 24, illustrated in FIG. 10. The bucket 23 allows the present invention to be used without an existing toilet. The bucket 23 retains any excrement that falls through the excrement-receiving hole 9. As seen in FIG. 9, the rim 24 suspends the bucket 23 from the posterior-bracing plate 8, as the rim 24 is laterally connected around an opening 27 of the bucket 23, as seen in FIG. 10. The bucket 23 is positioned into the excrement-receiving opening 9, preventing the excrement from escaping the bucket 23. The rim 24 is positioned in between the posterior-bracing plate 8 and the platform 5 and is pressed against the platform 5 by the posterior-bracing plate 8. This arrangement secures the position of the bucket 23 within the excrement-receiving hole 9.

Although the invention has been explained in relation to its preferred embodiment, it is to be understood that many other possible modifications and variations can be made without departing from the spirit and scope of the invention as hereinafter claimed.

What is claimed is:

1. An inclining toilet-seat lift comprises:
- a U-shaped base;
- a plurality of supporting legs;
- a platform;
- a posterior-bracing plate;
- an excrement-receiving hole;
- a lifting mechanism;
- the platform comprises a first edge and a second edge;
- the first edge and the second edge being positioned opposite to each other across the platform;
- the second edge being positioned adjacent to an opening of the U-shaped base;
- the platform being terminally connected to the plurality of supporting legs;
- the plurality of supporting legs being peripherally positioned around the platform;
- the U-shaped base being terminally connected to the plurality of supporting legs, opposite the platform;
- the posterior-bracing plate being positioned adjacent to the platform, opposite the plurality of supporting legs;
- the posterior-bracing plate being hingedly connected along the first edge;
- the excrement-receiving hole traversing through the posterior-bracing plate and the platform; and,
- the lifting mechanism being operatively coupled between the posterior-bracing plate and the U-shaped base, wherein the lifting mechanism is used to raise and lower the posterior-bracing plate.

2. The inclining toilet-seat lift as claimed in claim 1 comprises:
- a bin;
- a cover;
- the bin being mounted onto the U-shaped base; and,
- the cover being detachably attached across an opening of the bin.

3. The inclining toilet-seat lift as claimed in claim 1 comprises:
- each of the plurality of supporting legs comprises a series of telescopic rods and a locking mechanism;
- the series of telescopic rods being slidably engaged amongst each other; and,
- the locking mechanism being operatively integrated into the series of telescopic rods, wherein the locking mechanism is used to adjust and fix a total length for the series of telescopic rods.

4. The inclining toilet-seat lift as claimed in claim 1 comprises:
- a first handlebar;
- a second handlebar;
- the first handlebar being mounted adjacent to the platform;
- the second handlebar being mounted adjacent to the platform, opposite the first handlebar; and,
- the first handlebar and the second handlebar being positioned in between the first edge and the second edge.

5. The inclining toilet-seat lift as claimed in claim 1 comprises:
- a toilet seat;
- the toilet seat being mounted onto the posterior-bracing plate, opposite the platform; and,
- the toilet seat being perimetrically positioned around the excrement-receiving hole.

6. The inclining toilet-seat lift as claimed in claim 5 comprises:
- a seat cover;
- the seat cover being coextensive with the toilet seat;
- the seat cover being hingedly connected to the posterior-bracing plate; and,
- the hinged connection between the seat cover and the posterior-bracing plate being positioned adjacent to the toilet seat.

7. The inclining toilet-seat lift as claimed in claim 1 comprises:
- the lifting mechanism comprises at least one linear actuator;
- the linear actuator comprises a pushing end and a fixed end;
- the fixed end being pivotably connected to the U-shaped base;
- the pushing end being pivotably connected to the posterior-bracing plate; and,
- the pushing end being positioned offset from the hinged connection between the posterior-bracing plate and the platform.

8. The inclining toilet-seat lift as claimed in claim 1 comprises:
- a control unit;
- a power source;
- the control unit being connected adjacent to the platform;

the control unit being positioned in between the plurality of supporting legs and the posterior-bracing plate;

the control unit being electronically connected to the lifting mechanism;

the power source being mounted onto the U-shaped base; and, the power source being electrically connected to the control unit and the lifting mechanism.

9. The inclining toilet-seat lift as claimed in claim 1 comprises:

a plurality of wheel assemblies;

the plurality of wheel assemblies being mounted adjacent to the U-shaped base, opposite to the plurality of supporting legs; and, the plurality of wheel assemblies being distributed around the U-shaped base.

10. The inclining toilet-seat lift as claimed in claim 1 comprises:

a bucket;

a rim;

the rim being laterally connected around an opening of the bucket;

the bucket being positioned into the excrement-receiving hole;

the rim being positioned in between the posterior-bracing plate and the platform; and, the rim being pressed against the platform by the posterior-bracing plate.

11. The inclining toilet-seat lift as claimed in claim 1 comprises:

a bucket;

a rim;

the rim being laterally connected around an opening of the bucket;

the bucket being positioned into the excrement-receiving hole;

the rim being positioned in between the posterior-bracing plate and the platform; and, the rim being pressed against the platform by the posterior-bracing plate.

12. An inclining toilet-seat lift comprises:

a U-shaped base;

a plurality of supporting legs;

a platform;

a posterior-bracing plate;

an excrement-receiving hole;

a lifting mechanism;

the platform comprises a first edge and a second edge;

each of the plurality of supporting legs comprises a series of telescopic rods and a locking mechanism;

the first edge and the second edge being positioned opposite to each other across the platform;

the second edge being positioned adjacent to an opening of the U-shaped base;

the platform being terminally connected to the plurality of supporting legs;

the plurality of supporting legs being peripherally positioned around the platform;

the U-shaped base being terminally connected to the plurality of supporting legs, opposite the platform;

the posterior-bracing plate being positioned adjacent to the platform, opposite the plurality of supporting legs;

the posterior-bracing plate being hingedly connected along the first edge;

the excrement-receiving hole traversing through the posterior-bracing plate and the platform;

the lifting mechanism being operatively coupled between the posterior-bracing plate and the U-shaped base, wherein the lifting mechanism is used to raise and lower the posterior-bracing plate;

the series of telescopic rods being slidably engaged amongst each other; and, the locking mechanism being operatively integrated into the series of telescopic rods, wherein the locking mechanism is used to adjust and fix a total length for the series of telescopic rods.

13. The inclining toilet-seat lift as claimed in claim 12 comprises:

a bin;

a cover;

the bin being mounted onto the U-shaped base; and, the cover being detachably attached across an opening of the bin.

14. The inclining toilet-seat lift as claimed in claim 12 comprises:

a first handlebar;

a second handlebar;

the first handlebar being mounted adjacent to the platform;

the second handlebar being mounted adjacent to the platform, opposite the first handlebar; and, the first handlebar and the second handlebar being positioned in between the first edge and the second edge.

15. The inclining toilet-seat lift as claimed in claim 12 comprises:

a toilet seat;

a seat cover;

the toilet seat being mounted onto the posterior-bracing plate, opposite the platform;

the toilet seat being perimetrically positioned around the excrement-receiving hole;

the seat cover being coextensive with the toilet seat;

the seat cover being hingedly connected to the posterior-bracing plate; and, the hinged connection between the seat cover and the posterior-bracing plate being positioned adjacent to the toilet seat.

16. The inclining toilet-seat lift as claimed in claim 12 comprises:

the lifting mechanism comprises at least one linear actuator;

the linear actuator comprises a pushing end and a fixed end;

the fixed end being pivotably connected to the U-shaped base;

the pushing end being pivotably connected to the posterior-bracing plate; and, the pushing end being positioned offset from the hinged connection between the posterior-bracing plate and the platform.

17. The inclining toilet-seat lift as claimed in claim 12 comprises:

a control unit;

a power source;

the control unit being connected adjacent to the platform;

the control unit being positioned in between the plurality of supporting legs and the posterior-bracing plate;

the control unit being electronically connected to the lifting mechanism;

the power source being mounted onto the U-shaped base; and, the power source being electrically connected to the control unit and the lifting mechanism.

18. The inclining toilet-seat lift as claimed in claim 12 comprises:

a plurality of wheel assemblies;

the plurality of wheel assemblies being mounted adjacent to the U-shaped base, opposite to the plurality of supporting legs; and, the plurality of wheel assemblies being distributed around the U-shaped base.

* * * * *